United States Patent [19]

Kawano

[11] Patent Number: 4,966,808

[45] Date of Patent: Oct. 30, 1990

[54] MICRO-FIBERS-GENERATING CONJUGATE FIBERS AND WOVEN OR NON-WOVEN FABRIC THEREOF

[75] Inventor: Michinori Kawano, Kyoto, Japan

[73] Assignee: Chisso Corporation, Ohsaka, Japan

[21] Appl. No.: 468,860

[22] Filed: Jan. 23, 1990

[30] Foreign Application Priority Data

Jan. 27, 1989 [JP] Japan ..... 1-18269

[51] Int. Cl.[5] ..... D02G 3/02

[52] U.S. Cl. ..... 428/224; 428/299; 428/373; 428/374; 428/903

[58] Field of Search ..... 428/224, 299, 373, 903, 428/374

[56] References Cited

U.S. PATENT DOCUMENTS

| | | | |
|---|---|---|---|
| 3,681,189 | 8/1972 | Matsui et al. | 428/373 |
| 4,117,194 | 9/1978 | Barbe et al. | 428/374 |
| 4,127,696 | 11/1978 | Okamoto | 428/374 |
| 4,243,713 | 1/1981 | Worrall et al. | 428/374 |
| 4,381,335 | 4/1983 | Okamoto | 428/374 |
| 4,496,619 | 1/1985 | Okamoto | 428/374 |
| 4,627,950 | 12/1986 | Matsui et al. | 428/373 |
| 4,789,592 | 12/1988 | Taniguchi et al. | 428/374 |

FOREIGN PATENT DOCUMENTS 062297 8/1971 Japan .

*Primary Examiner*—James J. Bell

*Attorney, Agent, or Firm*—Fay, Sharpe, Beall, Fagan, Minnich & McKee

[57] ABSTRACT

Micro-fibers-generating conjugate fibers having a practically sufficient tenacity, a broad tolerance of spinning conditions and a stabilized spinnability, and a woven fabric or non-woven fabric prepared from the same are provided, which micro-fibers-generating conjugate fibers comprises one conjugate component of island-in-sea structure and the other conjugate component of a normal structure, the former component being exposed on the surface of the conjugate fiber and the sea part of the island-in-sea structure being removed by a solvent treatment at a later stage after or before forming into a woven or non-woven fabric to generate micro-fibers along with the fibers of the other component.

5 Claims, 1 Drawing Sheet

MICRO-FIBERS-GENERATING CONJUGATE FIBERS AND WOVEN OR NON-WOVEN FABRIC THEREOF

BACKGROUND OF THE INVENTION

1. Field of the Invention

This invention relates to micro-fibers-generating conjugate fibers. More particularly it relates to micro-fibers-generating conjugate fibers from which micro-fibers are generated by removing a part of components constituting the conjugate fibers, and a woven fabric or non-woven fabric using the same.

2. Description of the Related Art

Recently, as high-class and diversified clothes have been desired, improvement in feeling of fibers by way of making fibers very fine has been attempted, and further as use applications of synthetic paper, non-woven fabric, etc. are developed, a process for producing micro-fibers has been also desired to be developed. Among micro-fibers-generating fibers, those of the so-called island-in-sea type fibers are very useful and it is well-known that a number of products using the same are commercially available.

Among the island-in-sea type, micro-fibers-generating fibers, particularly those wherein the island-in-sea structure is relied on a polymer blend, as disclosed in Japanese patent publication No. Sho 47-37648/1972, are prepared by blending different kinds of polymers constituting the respective components of island and sea, melt-spinning the resulting blend and removing the sea component with a solvent to leave only the island component. In such fibers, the blending proportion of the sea component should be large for keeping the independency of the island component. However, the sea component is used for temporarily binding a bundle of micro-fibers, and is to be finally removed. Hence the binding component cannot be a reinforcing component. So, the micro-fibers-generating fibers of this type could not have a high tenacity. Further, the bundle of micro-fibers as a remaining island component obtained by removing the sea component from the island-in-sea type micro-fibers-generating fibers has a low tenacity.

Further, as to the spinnability of fibers obtained by subjecting different kinds of polymers to composite spinning so as to give an island-in-sea structure as disclosed in Japanese patent application laid-open No. Sho 60-21904(1985), since the spinnability of the sea component is very often inferior, the spinnability of the island-in-sea type fibers is inferior, too. Further, in the case of fibers the island-in-sea components of which are of a polymer blend, since polymers having different properties from each other are blended, a satisfactory spinning stability cannot be obtained. So, the polymer is extruded from spinning nozzles in a thick and fine form and the extrudate is liable to break like raindrops.

SUMMARY OF THE INVENTION

The object of the present invention is to provide micro-fibers-generating fibers having a tenacity enough for practical uses, and a stabilized spinnability.

The present inventor has made extensive research in order to solve the above-mentioned problems of micro-fibers-generating fibers, and as a result has found that when micro-fibers-generating fibers are composed of conjugate fibers; at least one of the conjugate components of the conjugate fibers has an island-in-sea structure and is exposed on the surface of the fibers; the island component of the structure constitutes micro-fibers of 0.1 denier or less; and the other composite components constitute fibers of 0.5 denier or larger, and micro-fibers of 0.1 denier or less consisting of the island component are generated in the vicinity of the fibers of 0.5 denier or larger after removing the sea structure of the island-in-sea component, thereby exhibiting a high tenacity due to the fibers of the other components as well as a specific feeling of micro-fibers.

The present invention has the following features.

(1) Micro-fibers-generating conjugate fibers, wherein at least one conjugate component of said fibers has an island-in-sea structure, said micro-fibers-generating conjugate fibers has a fineness of one denier or more, preferably 2–10 denier, the other conjugate component of said micro-fibers-generating fibers has a fineness of 0.5 denier or more, preferably 1–5 denier, said at least one conjugate component having an island-in-sea structure is exposed on the surface of said microfibers-generating fibers, the sea part of said conjugate component is removable by a solvent treatment, the island part of said conjugate component after removing the sea part has a fineness of 0.1 denier or less, preferably 0.1–0.0001 denier.

(2) A woven or non-woven fabric having micro-fibers obtained from a woven or non-woven fabric prepared by using micro-fibers-generating conjugate fibers as set forth in (1), by removing the sea part contained in said conjugate fibers:

(3) A woven or non-woven fabric having micro-fibers obtained from a woven or non-woven fabric prepared by using micro-fibers-generating conjugate fibers as set forth in (1) and hot-melt adhesive fibers, by removing the sea part contained therein, before or after subjecting said woven fabric or non-woven fabric to hot-melt adhesive treatment:

(4) A woven or non-woven fabric obtained from a woven or non-woven fabric prepared by applying a binder to the (1), by removing the sea part contained therein.

(5) Conjugate micro-fibers obtained by removing the sea part of the conjugate component of the micro-fibers-generating generating conjugate fibers as set forth in (1).

In these figures, numeral 1 represents one conjugate component, 2 represents island part, 3 represents sea part and 4 represents the other conjugate component.

DETAILED DESCRIPTION OF PREFERRED EMBODIMENTS

Figure 1:
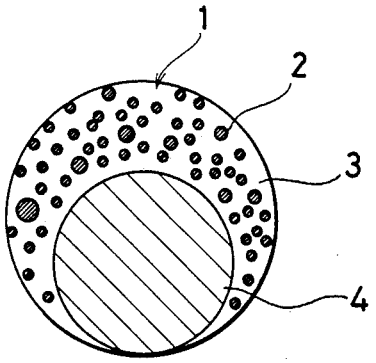
FIG. 1 shows a cross-section of micro-fibers-generating conjugate fibers of side-by-side type.
Figure 2:
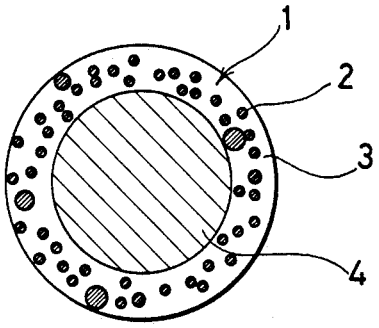
FIG. 2 shows a cross-section of micro-fibers-generating conjugate fibers of sheath-and-core type.

The configuration of the conjugate fibers in the present invention has no particular limitation as far as the component having an island-in-sea structure as a component generating micro-fibers is exposed on the surface of the conjugate fibers. Examples of such conjugate fibers are shown in FIGS. 1 and 2. Referring to FIG. 1, one component 1 and the other component 4 constitute a side-by-side type conjugate fiber. The component 1 has an island-in-sea structure. In FIG. 2, a sheath component 1 and a core component 4 constitute a sheath-and-core type conjugate fiber. In these figures, the island-in-sea structure consists of a sea part 3 and an island part 2.

Examples of resins usable as the island part 2 and the above other component 4 are polyolefins such as polyethylene, polypropylene, etc., polyamides such as nylon 6, nylon 66, etc. and thermoplastic polyesters such as polyethylene terephthalate, polybutylene terephthalate, etc. Further, examples of resins usable as the sea part 3 are those which are removable without having a bad effect upon the island part or components other than the sea part, such as partially saponified polyvinyl alcohol (water-soluble), copoly(ethylene-terephthalate-5-sodium sulfoisophthalate) hydrolyzable with alkaline, etc.

As a solvent for removing the sea part, water, preferably a hot water, alkaline water are exemplified.

As a process for producing micro-fibers-generating conjugate fibers, any conventional process for spinning a conjugate fiber of sheath-core type or side-by-side type may be employed, provided that at least one of the conjugate components of the fiber has an island-in-sea structure and is exposed on the surface of the conjugate micro-fibers-generating fiber. The other conjugate component of the fiber has a normal structure. For obtaining the island-in-sea structure, a process of subjecting both the polymers for island and sea parts to blending, as disclosed in Japanese patent publication No. Sho 47-37648/1972, a process of dividing one component flow of resin into a plurality of flows and combining the flows with the other component flow of resin to form a conjugate flow of resin to a spinneret, as disclosed in Japanese patent application laid-open No. Sho 60-21904/1985, etc. are exemplified.

After spinning of micro-fibers-generating conjugate fibers, they are subjected to a woven or non-woven fabric processing. The fibers may be drawned at a proper ratio to increase the tenacity thereof before the processing. As a woven or non-woven fabric processing, any conventional processes may be employed such as a spunbonding process, a meltblowing process, a needlepunching process, a stitchbonding process, a spunlacing process, a paper machine process, a woven machine process, etc.

A step of removing the sea part of the conjugate components of the fibers may be carried out either in the form of micro-fibers-generating conjugate fibers or in the form of a woven or non-woven fabric consisting of the fibers.

The present invention will be described in more detail by way of Examples, but it should not be construed to be limited thereto.

EXAMPLE 1

A blend of a thermoplastic polyvinyl alcohol (polymerization degree 400; saponification degree 62%) with a polypropylene (MFR (melt flow rate)=10) in a ratio by weight of 3:2 as an island-in-sea component and a high density polyethylene (MI (melt index)=30) as the other component were each fed into a spinneret of side-by-side type having spinning holes of 0.4 mm in diameter (the total number of the spinning holes: 198) at a rate of 100 g/min., and extrudated from the spinneret at a spinning temperature of 210° C., followed by drawing of the extruded fibers according to spunbonding process at a rate of 500 m/min. to obtain a fleece of micro-fibers-generating conjugate fibers of side-by-side type.

The resulting fleece was subjected to water needle punching to simultaneously carry out removal of the sea component and interlacing the fibers, whereby a non-woven fabric of micro-fibers (basis weight 60 g/m$^2$). The resulting non-woven fabric was observed by a microscope, and the micro-fibers having a fineness of 0.0001 to 0.1 denier and normal-fibers having a fineness of 3 denier were observed.

The non-woven fabric had a tensile break strength of 0.12 kg per test piece of 5 cm wide and 10 cm in length (in the mechanical direction).

EXAMPLE 2

A blend of a thermoplastic polyvinyl alcohol (polymerization degree: 400 and saponification degree: 62%) with a polypropylene (MFR=20) in a ratio by weight of 1:1, as a sheath component resin, at a rate of 100 g/min., and a polypropylene (MFR=40) as a core component resin, at a rate of 50 g/min., were each fed into a spinneret having circular spinning holes of 0.6 mm in diameter, followed by extrudation from the spinneret at a spinning temperature of 240° C. and drawing at a rate of 428 m/min. to obtain microfibers-generating conjugate fibers of sheath-and-core type. The cross-section of the resulting unstretched fibers was observed by a microscope and the component having an island-in-sea structure was observed to be present surrounding the core component having a fineness of 3 denier, the number of islands being several hundreds.

The resulting micro-fibers-generating conjugate fibers were stretched to three times the original length to obtain drawned micro-fibers-generating conjugate fibers. The drawned fibers had a tensile break strength of 0.5 g/d. Further, staple fibers obtained by cutting the above fibers into those of 51 mm long were blended with hot-melt adhesive conjugate fibers (sheath component: polyethylene, and core component: polypropylene) (2 d, 51 mm) in a ratio by weight of 1:1, followed by carding of the blended fibers, to form a web. The resulting web was subjected to a heat treatment by means of emboss rolls heated at 130° C. to obtain a non-woven fabric. After washing with hot water at 80° C., a non-woven fabric of polypropylene fibers having a fineness of 0.0002 to 0.1 denier and a basis weight of 50 g/m$^2$ was obtained. The non-woven fabric had a break strength of 7.3 kg per test piece of 5 cm wide and 10 cm in length (in the machine direction).

EXAMPLE 3

The staple fibers of the micro-fibers-generating conjugate fibers obtained in Example 2 were carded into a web, followed by subjecting the web to water-needlepunching, simultaneously removing the sea component and interlacing the fibers, coating the resulting web with an acrylic resin emulsion and impregnate the emulsion with the web and drying to obtain a non-woven fabric containing micro-fibers of polypropylene having a fineness of 0.0002 to 0.1 denier and normal-fiber having a fineness of 3 denier, and having a basis weight of 150 g/m$^2$. This non-woven fabric had a break strength of 3.3 kg per test piece of 5 cm wide and 10 cm in length (in the machine direction).

EXAMPLE 4

By passing the stretched fibers obtained in Example 2, though a hot water tank, the sea component was removed to obtain a fiber bundle comprising micro-fibers of polypropylene fibers of 0.0002 to 0.1 denier and normal-fibers of 3 denier. The break strength of the fiber bundle was 1 g/d.

EXAMPLE 5

A blend of carboxylic acid-modified thermoplastic polyvinyl alcohol (polymerization degree: 300 and saponification degree: 62%) with a polypropylene (MFR=20) in a blending ratio by weight of 1:1 as a sheath component resin and a polypropylene (MFR=20) as a core component resin were each fed into a spinneret having circular spinning holes of 1.0 mm in diameter (the total number of spinning holes: 240) at a rate of 100 g/min. at a spinning temperature of 240° C., extruded through the spinning holes, and drawned at a rate of 428 m/min. to obtain composite micro-fibers-generating fibers of sheath-and-core type. The cross-section of the undrawned fibers was observed by a microscope. As a result, the sheath component having an island-in-sea structure was present surrounding the core component, the number of the islands being several hundreds.

The resulting micro-fibers-generating conjugate fibers were drawned to four times the original length to obtain drawned micro-fibers-generating conjugate fibers. Further, the fibers were cut into those of 3 mm, followed by subjecting them to wet paper processing to obtain a non-woven fabric of micro-fibers of polypropylene of 0.02 to 0.1 denier and normal-fiber of 2.2 denier, and having a basis weight of 100 g/m$^2$. The resulting non-woven fabric had a break strength of about 0.8 kg per test piece of 5 cm wide and 10 cm in length.

The micro-fibers-generating conjugate fibers of the present invention comprise a part having an island-in-sea structure, which generates micro-fibers of 0.1 denier or less, and the other part which generates fibers of 0.5 denier or more; hence the fibers have a high break strength as micro-fibers-generating fibers. Thus, a sufficient tenacity of the fibers for practical use is obtained. Further, in the aspect of production, too, as compared with the case where spinning is carried out with only a component having an island-in-sea structure, a broader range of spinning conditions and a stabilized spinnability are obtained by subjecting the component having the island-in-sea structure to conjugate-spinning with the other component having good spinning properties.

Further, a woven or non-woven fabric comprising micro-fibers obtained from the micro-fibers-generating conjugate fibers has a high strength, a toughness, and a specific feeling, since the micro-fibers of 0.1 denier or less follow about or supported by a fiber of 0.5 denier or more.

What we claim:

1. Micro-fibers-generating conjugate fibers, wherein at least one conjugate component of said fibers has an island-in-sea structure, said micro-fibers-generating conjugate fibers has a fineness of one denier or more, the other conjugate component of said micro-fibers-generating conjugate fibers has a fineness of 0.5 denier or more, said at least one conjugate component having an island-in-sea structure is exposed on the surface of said micro-fibers-generating conjugate fibers, the sea part of said conjugate component is removable by a solvent treatment, the island part of said conjugate component after removing the sea part has a fineness of 0.1 denier or less.

2. A woven or non-woven fabric having micro-fibers obtained by removing from a woven or non-woven fabric prepared by using micro-fibers-generating conjugate fibers as set forth in claim 1, the sea part contained in said fibers.

3. A woven or non-woven fabric having micro-fibers, obtained by removing from a woven or non-woven fabric prepared by using micro-fibers-generating conjugate fibers as set forth in claim 1 and hot-melt adhesive fibers, the sea part contained therein, before or after subjecting said woven fabric or non-woven fabric to hot-melt adhesive treatment.

4. A woven or non-woven fabric obtained by removing from a woven or non-woven fabric prepared by applying a binder to the micro-fibers-generating conjugate fibers as set forth in claim 1, the sea part contained therein.

5. Micro-fibers obtained by removing the sea part of the conjugate component of the micro-fibers-generating conjugate fibers as set forth in claim 1.

* * * * *